US010551001B2

(12) United States Patent
Poorman et al.

(10) Patent No.: US 10,551,001 B2
(45) Date of Patent: Feb. 4, 2020

(54) FLOW CONTROL SYSTEM

(71) Applicant: J-W Power Company, Addison, TX (US)

(72) Inventors: Richard Allan Poorman, Diana, TX (US); Paul Howison Bergthold, Longview, TX (US); Courtney Ann McCollum, Longview, TX (US); Bradley Wade Fontenot, Longview, TX (US)

(73) Assignee: J-W Power Company, Addison, TX (US)

( * ) Notice: Subject to any disclaimer, the term of this patent is extended or adjusted under 35 U.S.C. 154(b) by 243 days.

(21) Appl. No.: 15/257,869

(22) Filed: Sep. 6, 2016

(65) Prior Publication Data

US 2017/0067600 A1 Mar. 9, 2017

Related U.S. Application Data

(60) Provisional application No. 62/214,168, filed on Sep. 3, 2015.

(51) Int. Cl.

| | |
|---|---|
| ***F17C 5/06*** | (2006.01) |
| ***F17C 7/00*** | (2006.01) |
| ***F17C 13/04*** | (2006.01) |

(52) U.S. Cl.

CPC ..... *F17C 5/06* (2013.01); *F17C 7/00* (2013.01); *F17C 13/04* (2013.01); *F17C 2221/033* (2013.01); *F17C 2227/0157* (2013.01); *F17C 2270/0581* (2013.01)

(58) Field of Classification Search

CPC .... F17C 5/06; F17C 13/04; F17C 7/00; F17C 2205/0326; F17C 2265/065; F17C 2250/043; F17C 2227/04; F17C 2225/036; F17C 2225/0123; F17C 2223/036; F17C 2223/0123; F17C 2205/0332; F17C 2270/0581; F17C 2227/0157; F17C 2221/033

See application file for complete search history.

(56) References Cited

U.S. PATENT DOCUMENTS

| | | | |
|---|---|---|---|
| 1,331,111 | A | 2/1920 | Jones |
| 1,969,137 | A | 8/1934 | Karge |
| 2,464,560 | A | 3/1949 | Davey |
| 2,695,132 | A | 11/1954 | Paget |
| 3,674,123 | A | 7/1972 | Lewis et al. |
| 3,780,756 | A | 12/1973 | Pennington |
| 3,799,218 | A | 3/1974 | Douglass |

(Continued)

FOREIGN PATENT DOCUMENTS

| | | | |
|---|---|---|---|
| CA | 2433722 | A1 | 12/2003 |
| EP | 0285099 | A1 | 10/1988 |

(Continued)

OTHER PUBLICATIONS

"BRC Fuelmaker: The full line for CNG refueling solutions—home, fleets, industry, filling stations", 16 pages.

*Primary Examiner* — Timothy L Maust

(74) *Attorney, Agent, or Firm* — Lightfoot & Alford PLLC

(57) ABSTRACT

A compressed natural gas (CNG) refueling station system includes a compressor, a dispenser, and at least one of a valve and an orifice disposed in fluid communication between the compressor and the dispenser.

8 Claims, 16 Drawing Sheets

(56) References Cited

U.S. PATENT DOCUMENTS 3,924,652 A 12/1975 Kah, Jr.
4,097,202 A 6/1978 Price
4,133,418 A 1/1979 Van Bilderbeek
4,178,963 A 12/1979 Riefler et al.
4,207,922 A 6/1980 Andrieux et al.
4,223,700 A 9/1980 Jones
4,291,724 A 9/1981 Miller
4,443,156 A 4/1984 Dunnam, Jr.
4,448,215 A 5/1984 Skelly
4,501,253 A 2/1985 Gerstmann et al.
4,515,516 A 5/1985 Perrine et al.
4,522,159 A 6/1985 Engel et al.
4,527,600 A 7/1985 Fisher et al.
4,531,558 A 7/1985 Engel et al.
4,624,390 A 11/1986 Palmer et al.
4,646,940 A 3/1987 Kramer et al.
4,653,986 A 3/1987 Ashton
4,749,384 A 6/1988 Nowobilski et al.
4,807,662 A 2/1989 Verne
4,886,401 A 12/1989 Andrews et al.
4,966,206 A 10/1990 Baumann et al.
5,029,622 A 7/1991 Mutter
5,129,459 A 7/1992 Breese et al.
5,169,295 A 12/1992 Stogner et al.
5,188,151 A 2/1993 Young et al.
5,263,826 A 11/1993 Baumann et al.
5,333,465 A 8/1994 McBride
5,351,726 A 10/1994 Diggins
5,370,159 A 12/1994 Price
5,377,762 A 1/1995 Turner
5,385,176 A 1/1995 Price
5,406,988 A * 4/1995 Hopkins ..... F17C 7/00 123/527
5,409,046 A 4/1995 Swenson et al.
5,431,203 A 7/1995 Schultz et al.
5,431,551 A 7/1995 Aquino et al.
5,441,234 A 8/1995 White et al.
5,458,167 A 10/1995 Schultz et al.
5,474,104 A 12/1995 Borland et al.
5,501,200 A 3/1996 Bogartz
5,522,369 A 6/1996 Povinger
5,538,051 A 7/1996 Brown et al.
5,586,587 A 12/1996 Leininger et al.
5,600,952 A * 2/1997 Aquino ..... F17C 5/02 60/421
5,613,532 A 3/1997 Kaliszewski
5,628,349 A 5/1997 Diggins et al.
5,656,090 A 8/1997 Preston et al.
5,673,735 A 10/1997 Crvelin et al.
5,676,180 A 10/1997 Teel
5,694,985 A 12/1997 Diggins
5,732,773 A 3/1998 Parks et al.
5,752,552 A 5/1998 Kountz et al.
5,771,948 A 6/1998 Kountz et al.
5,810,058 A 9/1998 Kountz et al.
5,862,833 A 1/1999 Perez
5,868,122 A 2/1999 Gram et al.
5,868,176 A 2/1999 Barajas et al.
5,884,675 A * 3/1999 Krasnov ..... F17C 5/06 141/18
5,887,567 A 3/1999 White et al.
5,921,291 A 7/1999 Hord et al.
6,000,430 A 12/1999 Nafz
6,135,170 A 10/2000 Lee et al.
6,257,360 B1 10/2001 Wozniak et al.
6,358,330 B1 3/2002 McGraw
6,360,793 B1 3/2002 Sugano et al.
6,516,810 B1 2/2003 Haul
6,619,336 B2 9/2003 Cohen et al.
6,672,065 B1 1/2004 Choroszylow et al.
6,732,769 B2 5/2004 Del Campo
7,011,118 B2 3/2006 Chan et al.
7,128,103 B2 10/2006 Mitlitsky et al.
7,168,464 B2 1/2007 Diggins
7,314,056 B2 1/2008 Yamashita et al.
7,325,561 B2 2/2008 Mathison et al.
7,415,995 B2 8/2008 Plummer et al.
7,913,506 B2 3/2011 Bittner et al.
7,967,036 B2 6/2011 Ding et al.
8,899,278 B2 12/2014 Cohen et al.
9,765,930 B2 * 9/2017 Poorman ..... F17C 5/02
9,765,933 B2 9/2017 Lambrix et al.
9,772,068 B2 9/2017 Mrowzinski
10,018,304 B2 * 7/2018 Poorman ..... F17C 5/00
10,072,342 B2 * 9/2018 Prescott ..... C25B 1/12
10,077,871 B2 * 9/2018 Blanchet ..... F17C 5/06
2004/0163731 A1 8/2004 Eichelberger et al.
2005/0236049 A1 10/2005 Manson et al.
2007/0079891 A1 4/2007 Farese et al.
2009/0151809 A1 6/2009 Balasubramanian et al.
2009/0250138 A1 10/2009 Bavarian et al.
2010/0037982 A1 2/2010 Bangs et al.
2010/0193070 A1 * 8/2010 Allidieres ..... F17C 5/06 141/11
2013/0192701 A1 8/2013 Poorman
2013/0248000 A1 9/2013 Killeen et al.
2013/0263609 A1 * 10/2013 MacKey ..... F17C 13/02 62/49.1
2014/0130938 A1 5/2014 Luparello
2015/0083273 A1 3/2015 Thiessen
2016/0116113 A1 4/2016 Mrowzinski
2016/0245459 A1 8/2016 Grimmer et al.
2017/0045182 A1 * 2/2017 Poorman ..... F17C 5/06
2017/0067600 A1 3/2017 Poorman et al.

FOREIGN PATENT DOCUMENTS

EP 1522430 A1 4/2005
EP 1798416 A1 6/2007
JP 09053798 A 2/1997
JP 2005127430 A1 5/2005
JP 4751014 B2 8/2011
KR 100699937 B1 3/2007
RU 2361144 C2 7/2009
WO 03018187 A2 3/2003

* cited by examiner

FLOW CONTROL SYSTEM

CROSS-REFERENCE TO RELATED APPLICATIONS

This patent application claims the benefit of the filing date of the U.S. Provisional Patent Application Ser. No. 62/214,168, filed on Sep. 3, 2015 and entitled "Flow Control System," the entire content of which is hereby expressly incorporated by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Filling vehicle tanks with compressed natural gas (CNG) can sometimes be time consuming and there is a need for prioritized filling of selected vehicle tanks.

DETAILED DESCRIPTION

Figure 1:
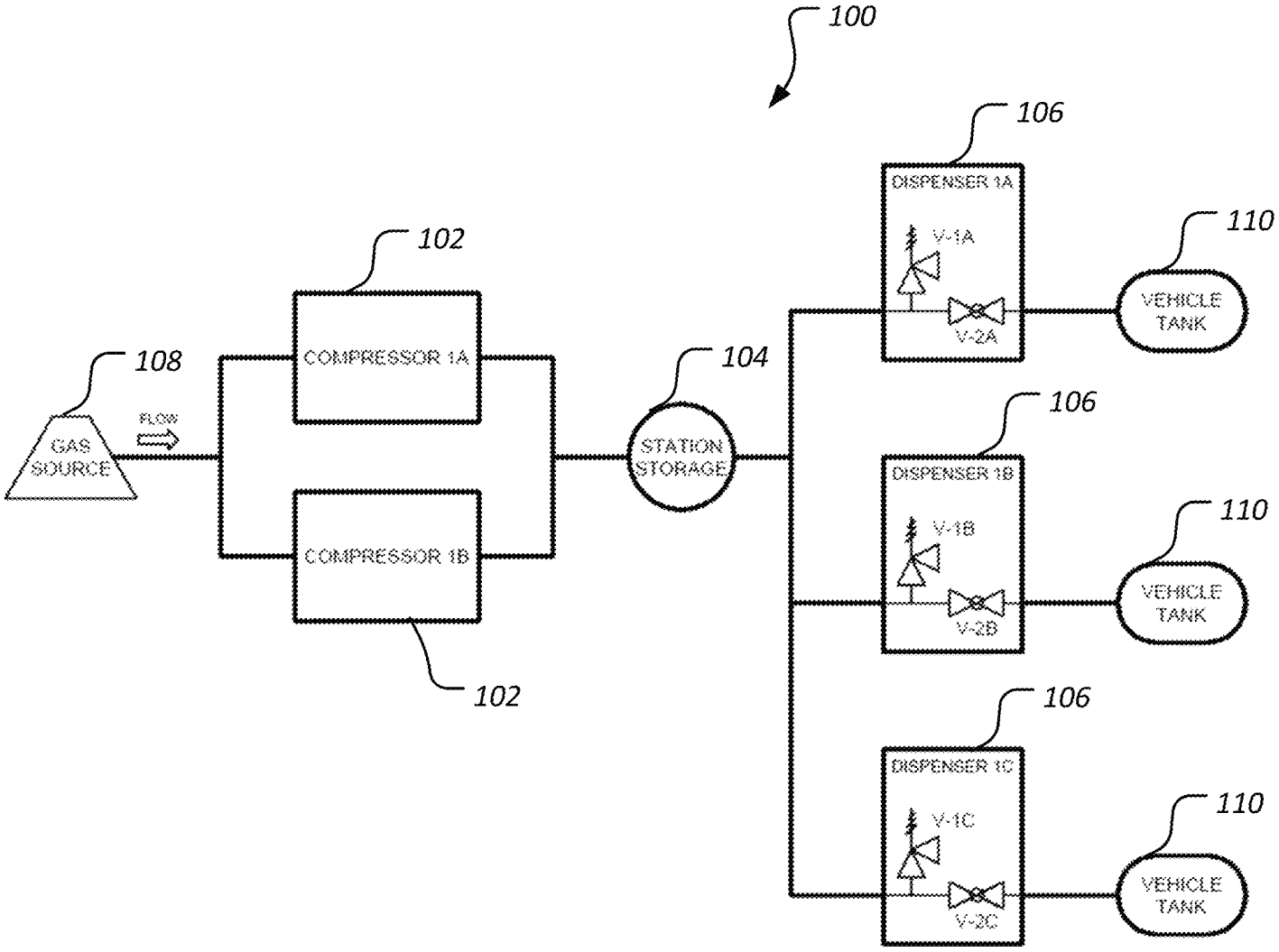
FIG. 1 is a schematic diagram of a compressed natural gas (CNG) compressed natural gas (CNG) refueling station system according to an embodiment of the disclosure.

Referring now to FIG. 1, a schematic diagram of embodiment of a compressed natural gas (CNG) refueling station system 100 is shown. The system 100 generally comprises a combination of at least one compressor 102, at least one station storage 104, and at least one dispenser 106. The compressors 102 are generally configured to receive natural gas from a gas source 108 and compress the natural gas to a pressure higher than the gas source 108 pressure. The CNG can be provided from the one or more compressors 102 to the station storage 104, from station storage 104 to the dispensers 106, and from the dispensers 106 to vehicle tanks 110. In alternative embodiments, the compressors 102 can be configured to selectively supply CNG directly to one or more of the dispensers 106.

The dispensers 106 require a differential pressure between the vehicle tanks 110 and the station storage 104 (or alternatively a pressure differential between the vehicle tanks 110 and the compressor 102 output pressure) to dispense CNG to the vehicle tanks 110. When multiple dispensers 106 are active (filling one or more vehicle tanks 110) the system 100 will balance the pressure drops to be the same between the CNG source relative to the dispensers 106, such as the station storage 104 or compressors 102, and the different destinations (vehicle tanks 110). This means that the CNG will flow to the lowest pressure vehicle tank 110 until that vehicle tank 110 pressure has risen up to the pressure of the next lowest vehicle tank 110 pressure. Next, CNG will flow to each of the vehicle tanks 110 until the CNG reaches the pressure of the next lowest vehicle tank 110 pressure. The end result can be that vehicle tanks 110 that begin being filled during the filling of other vehicle tanks 110 (such as in the case of later arriving vehicles), the vehicle tanks 110 of the simultaneously refilling vehicles will all finish filling at substantially the same time. For instance, consider a case where a vehicle #1 has been filling and the vehicle tank 110 of vehicle #1 is at 3000 psig and the vehicle tank 110 of vehicle #1 is considered filled when the pressure of the vehicle tank 110 of vehicle #1 reaches 3600 psig. When a vehicle #2 begins filling and has only 1500 psig in the vehicle tank 110 of vehicle #2, all of the gas that was flowing to vehicle #1 will be diverted and begin filling the vehicle tank 110 of vehicle #2. When the vehicle tank 110 for vehicle #2 reaches 3000 psig, the flow of CNG will be split between filling the vehicle tank 110 of vehicle #1 and the vehicle tank 110 of vehicle #2. The vehicle tanks 110 of both vehicles will reach 3600 psig at substantially the same time, regardless of when they began filling.

Figure 2:
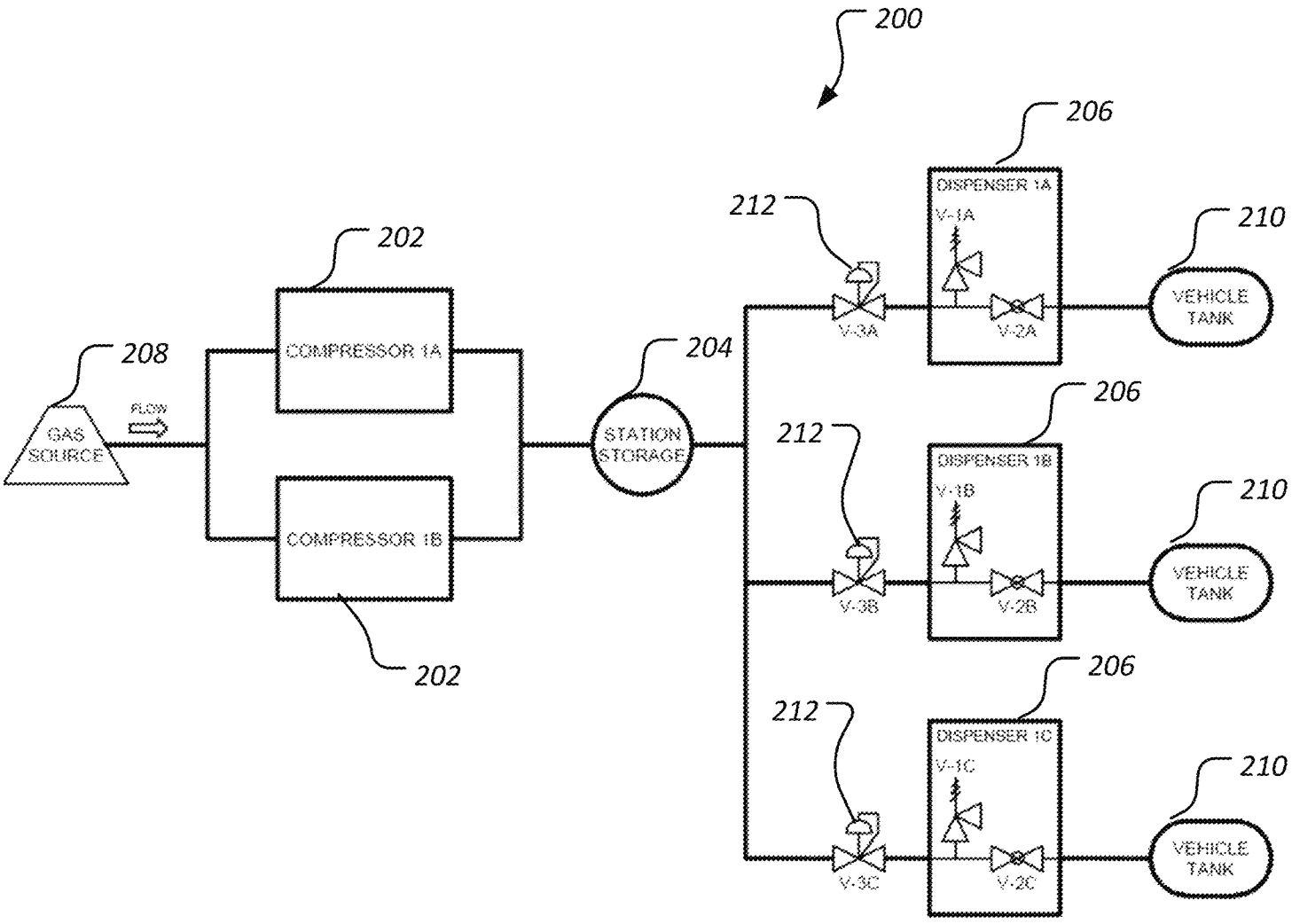
FIG. 2 is a schematic diagram of a compressed natural gas (CNG) compressed natural gas (CNG) refueling station system according to another embodiment.

Referring now to FIG. 2, a CNG refueling station system 200 is shown. The system 200 is substantially similar to system 100 but with the addition of valves 212 (V-3A, V-3B, V-3C) disposed in fluid communication between the station storage 204 and the dispensers 206. The addition of the valves 212 can allow a more timely fill for the first vehicle described above so that the first vehicle is refilled prior to the complete refilling of the second vehicle (first in first out).

The valves 212 can be used to control flow rate to the first vehicle, despite the arrival of subsequent vehicles and the later initiated filling of additional vehicle tanks 210. In some embodiments, the management of which vehicle tank 210 is completely filled first can comprise adding restrictions that cause corresponding pressure drops in the supply lines to the dispensers 206 associated with the relatively lower priority (last in) vehicles. When only one vehicle tank 210 (such as the vehicle tank 210 associated with dispenser 206 (such as dispenser 1A)) is filling, the valve 212 (such as valve V-3A) can remain wide open to minimize pressure drop between the vehicle tank 210 and the station storage 204. When a second vehicle tank 210 (such as the vehicle tank 210 associated with dispenser 206 (such as dispenser 1B)) begins to fill, the flow rate of CNG to the vehicle tank 210 associated with dispenser 1A and valve V-3A would be monitored. If the flow rate to the vehicle tank 210 the vehicle tank 210 associated with dispenser 1A and valve V-3A falls below a desired flow rate, the valve 212 (such as valve V-3B) can be selectively controlled to provide the necessary above-described restriction and/or pressure drop in order to maintain the desired flow rate to the vehicle tank 210 associated with dispenser 1A and valve V-3A. However, in alternative embodiments, the valves 212 can be included in one or more dispensers 206 and/or can replace an existing valve in a dispenser 206.

Figure 3:
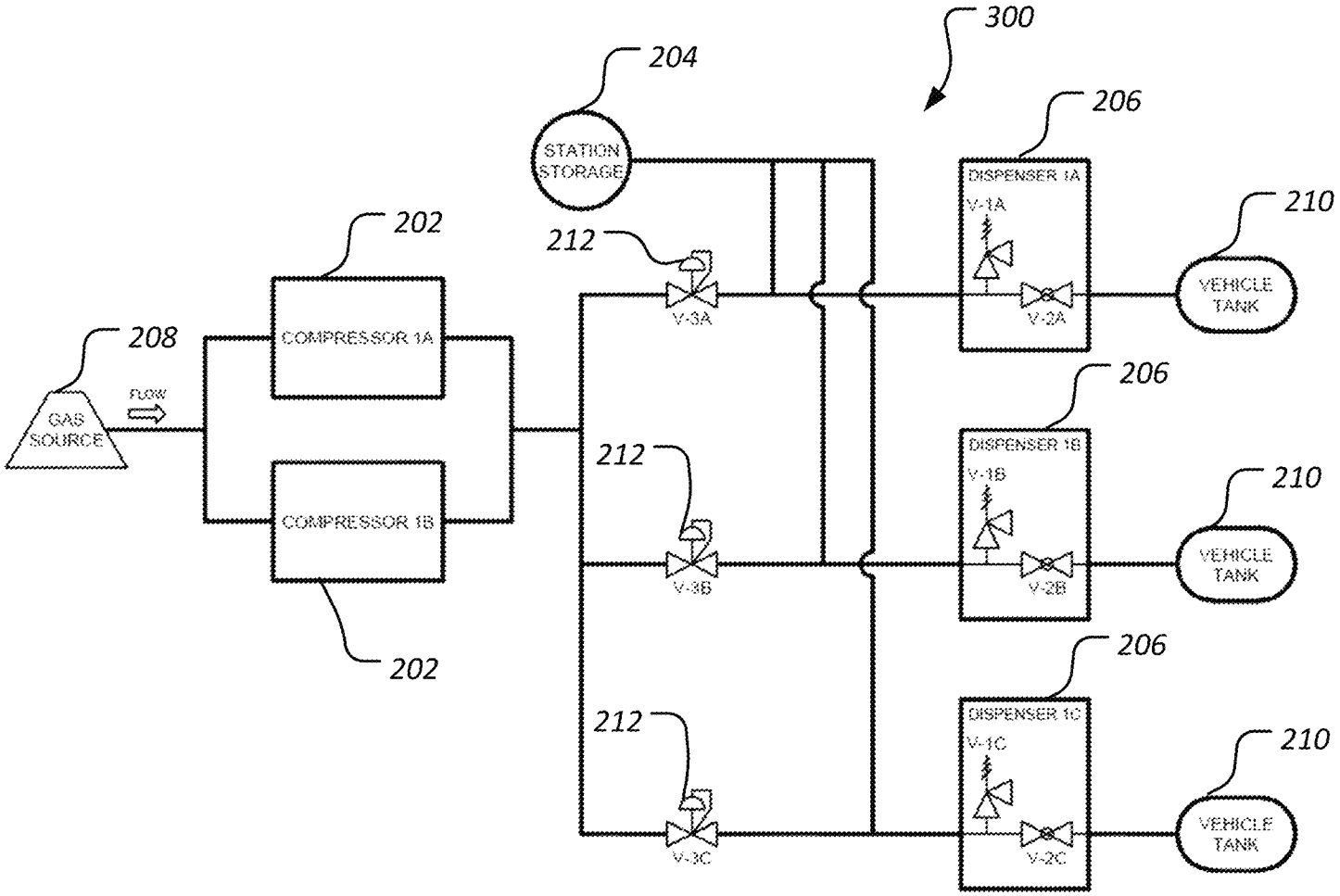
FIG. 3 is a schematic diagram of a compressed natural gas (CNG) compressed natural gas (CNG) refueling station system according to another embodiment.

Referring now to FIG. 3, a CNG refueling station system 300 is shown. The system 300 is substantially similar to the system 200. However, the station storage 204 is connected between the valves 212 and the dispensers 206 rather than upstream of the valves 212.

Figure 4:
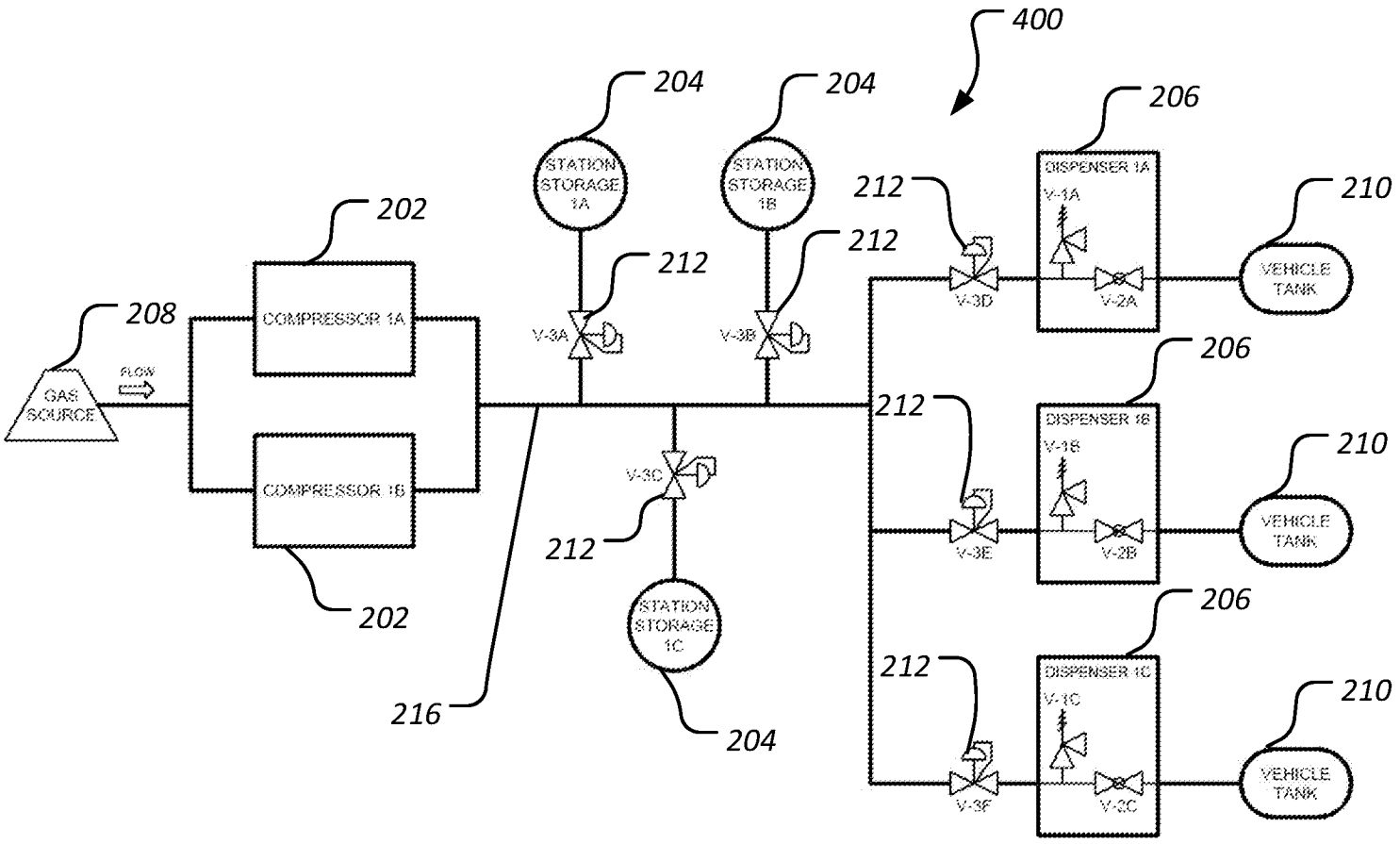
FIG. 4 is a schematic diagram of a compressed natural gas (CNG) compressed natural gas (CNG) refueling station system according to another embodiment.

Referring now to FIG. 4, a CNG refueling station system 400 is shown. The system 400 is substantially similar to the system 200. However, system 400 further comprises valves 212 (such as control valves V-3A-V-3C) disposed in fluid communication between the multiple station storage tanks 204 and the compressor header 216. System 400 comprises valves 212 (valves V-3D-V-3F) disposed in fluid communication between the dispensers 206 and the compressor discharge manifold 216. As compared to system 200, the addition of the control valves 212 (such as valves V-3A-V-3C) can allow a controller to push gas into the station storage tanks 204 while maintaining a constant dispensing pressure provided to the dispensers 206.

Figure 5:
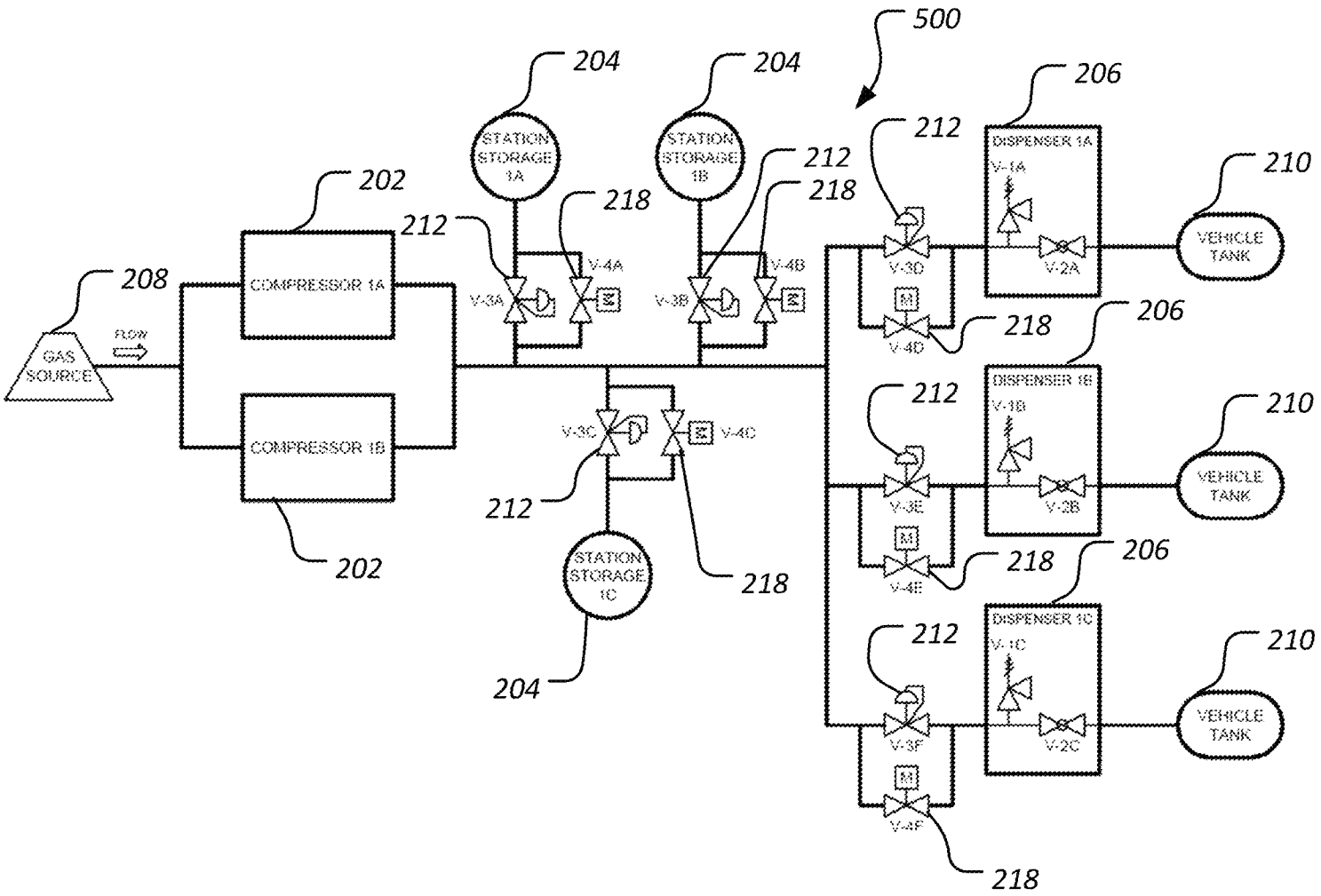
FIG. 5 is a schematic diagram of a compressed natural gas (CNG) compressed natural gas (CNG) refueling station system according to another embodiment.

Referring now to FIG. 5, a CNG refueling station system 500 is shown. The system 500 is substantially similar to the system 400. However, system 500 further comprises bypass valves 218 (such as valves V-4A-V-4F) disposed as potential bypasses around the valves 212 (valves V-3A-V-3F). The bypass valves 218 can be controlled to reduce pressure drop and increase flow rate in the lines in which valves 212 are disposed. In some cases, a vehicle that is in first priority (such vehicle A comprising a vehicle tank 210 associated with dispenser 206 (such as dispenser 1A), a bypass valve 218 (such as valve V-4D) can be relatively more open and/or fully open to minimize pressure drop while other bypass valves 218 (such as valve V-4B and V-4C) can remain relatively more closed and/or fully closed, thereby forcing the gas to travel through the valves 212 (such as valves V-3E and V-3F). In addition, the bypass valves 218 associated with the station storage tanks 204 (such as valve V-4A-V-4C) can remain open when the dispensers 206 are not actively filling vehicle tanks 210, thereby preventing a compressor 202 discharge pressure from being artificially raised while filling station storage tanks 204.

Figure 6:
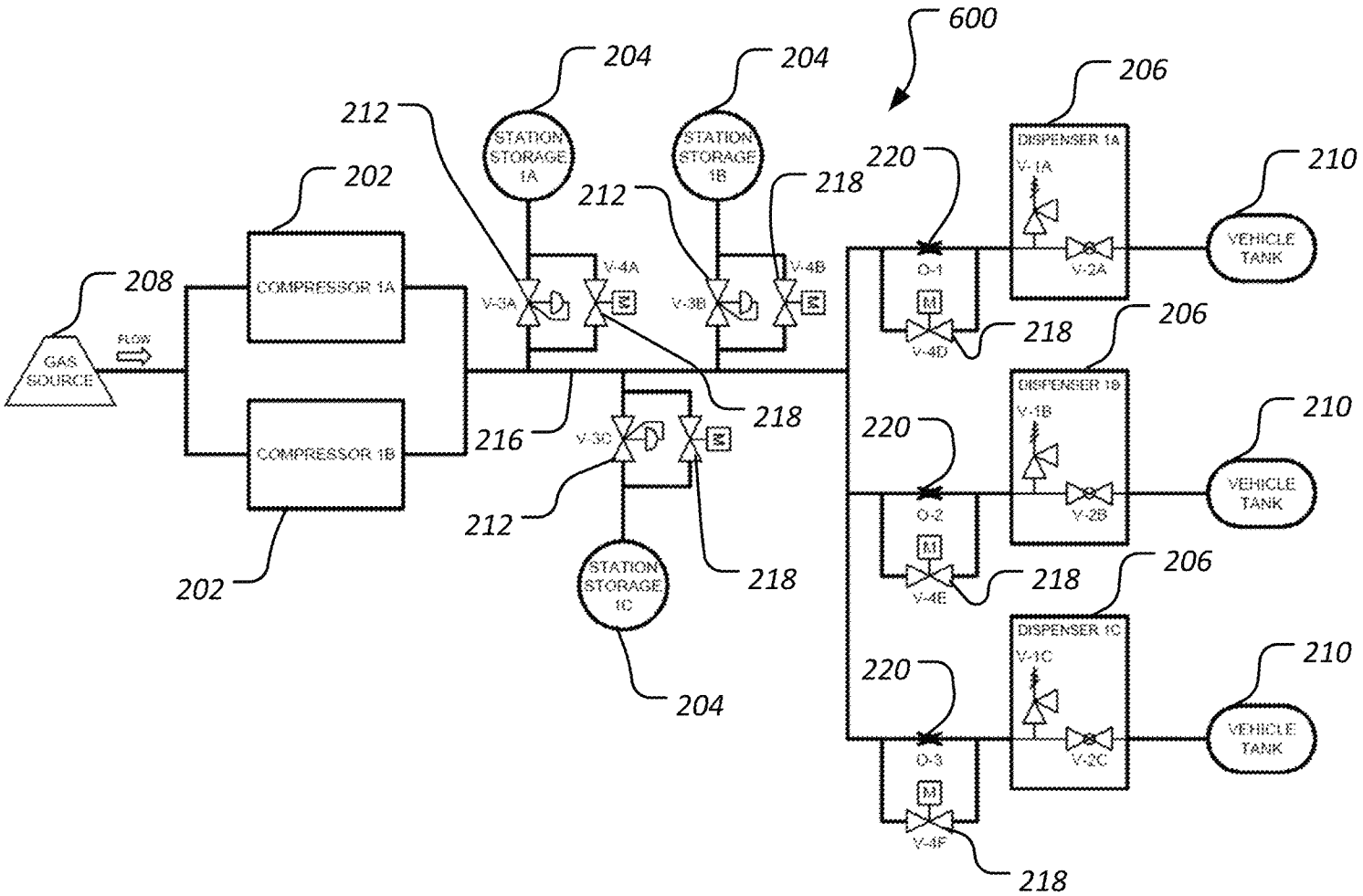
FIG. 6 is a schematic diagram of a compressed natural gas (CNG) compressed natural gas (CNG) refueling station system according to another embodiment.

Referring now to FIG. 6, a CNG refueling station system 600 is shown. The system 600 is substantially similar to the system 500. However, system 600 comprises orifices 220 (such as orifices O-1-O-3) rather than the valves 212 (such as valves V-3D-V-3F). In operation while filling a vehicle tank 210 using dispenser 206 (such as dispenser 1A), considered the first priority vehicle A, the bypass valve 218 (such as bypass valve V-4D) can remain open while other bypass valves 218 (such as bypass valves V-4E and V-4F) can be closed. The above-described orifices 220 can allow a small amount of gas to pass to the dispensers 206 while forcing the majority of the gas through the open bypass valve 218 (such as bypass valve V-4D). In some cases, the orifices 220 can be utilized to avoid completely shutting off the lower priority dispensers so that automatic time outs can be avoided. The automatic time outs can cause the dispensers 206 to shut off in response to not receiving an adequate flow rate for a predetermined period of time. The orifices 220 in system 600 can be adjusted/calibrated to ensure that the dispensers 206 can remain active (avoid timing out) while they are not in first priority. In some cases, as a vehicle tank 210 fills and the associated dispenser 206 deactivates, all of the vehicles (more specifically, vehicle tanks 210) can increase one position in priority.

Figure 7:
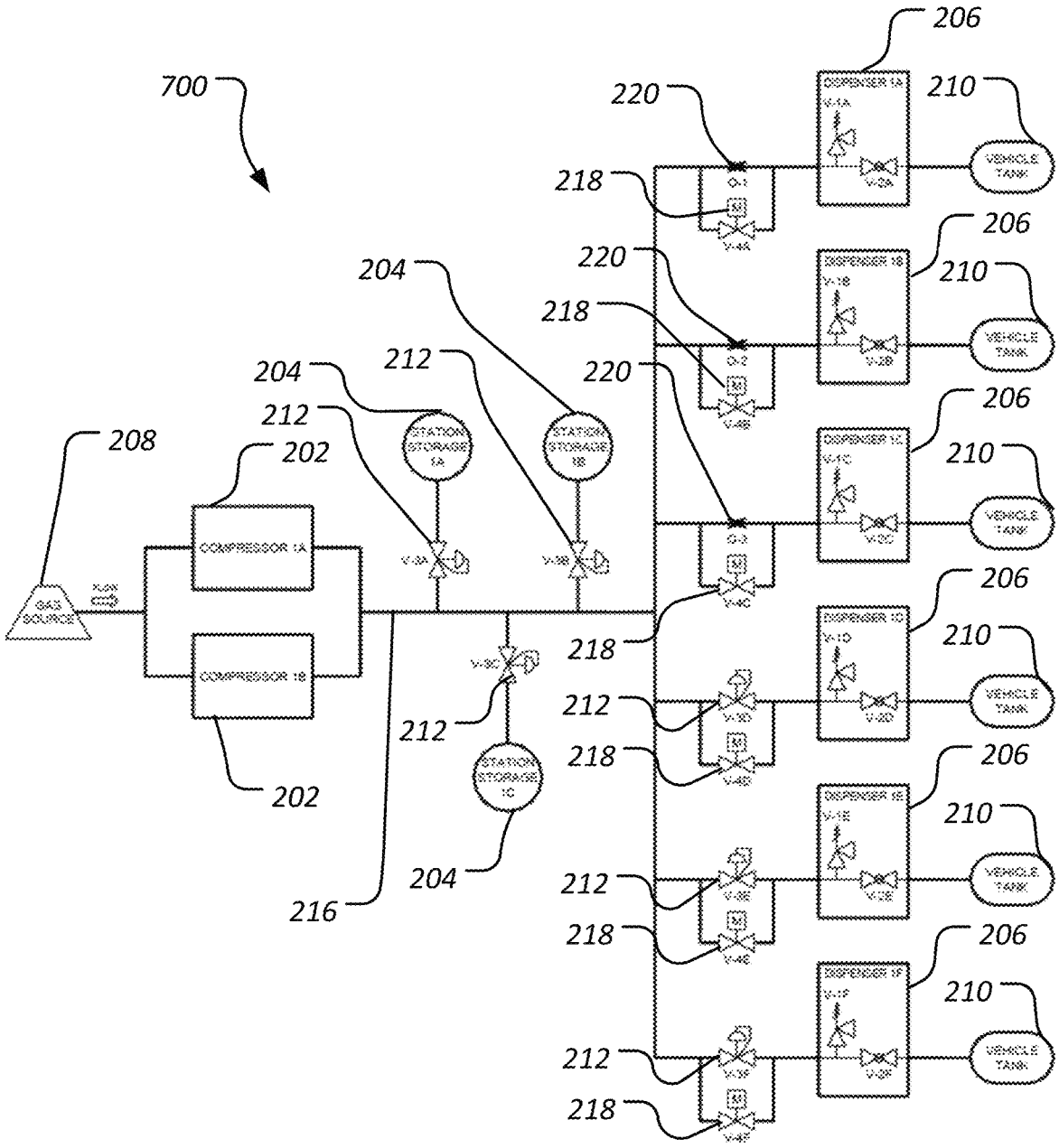
FIG. 7 is a schematic diagram of a compressed natural gas (CNG) compressed natural gas (CNG) refueling station system according to another embodiment.

Referring now to FIG. 7, a CNG refueling station system 700 is shown. The system 700 is substantially similar to system 500. However, system 700 further comprises the orifices 220 disclosed above with reference to system 600. In system 700, the orifices 220 are additional to the valves 212 rather than replacements for the valves 212. System 700 comprises both control valves 212 and orifices 220 disposed between the dispensers 206 and the output lines of the compressors 202 and/or station storage tanks 204. Depending on the size/flow/importance of the dispensers 206, the valves 212 and/or orifices 220 can be selectively controlled by either controlling the valves 212 and/or the orifices 220.

Figure 8:
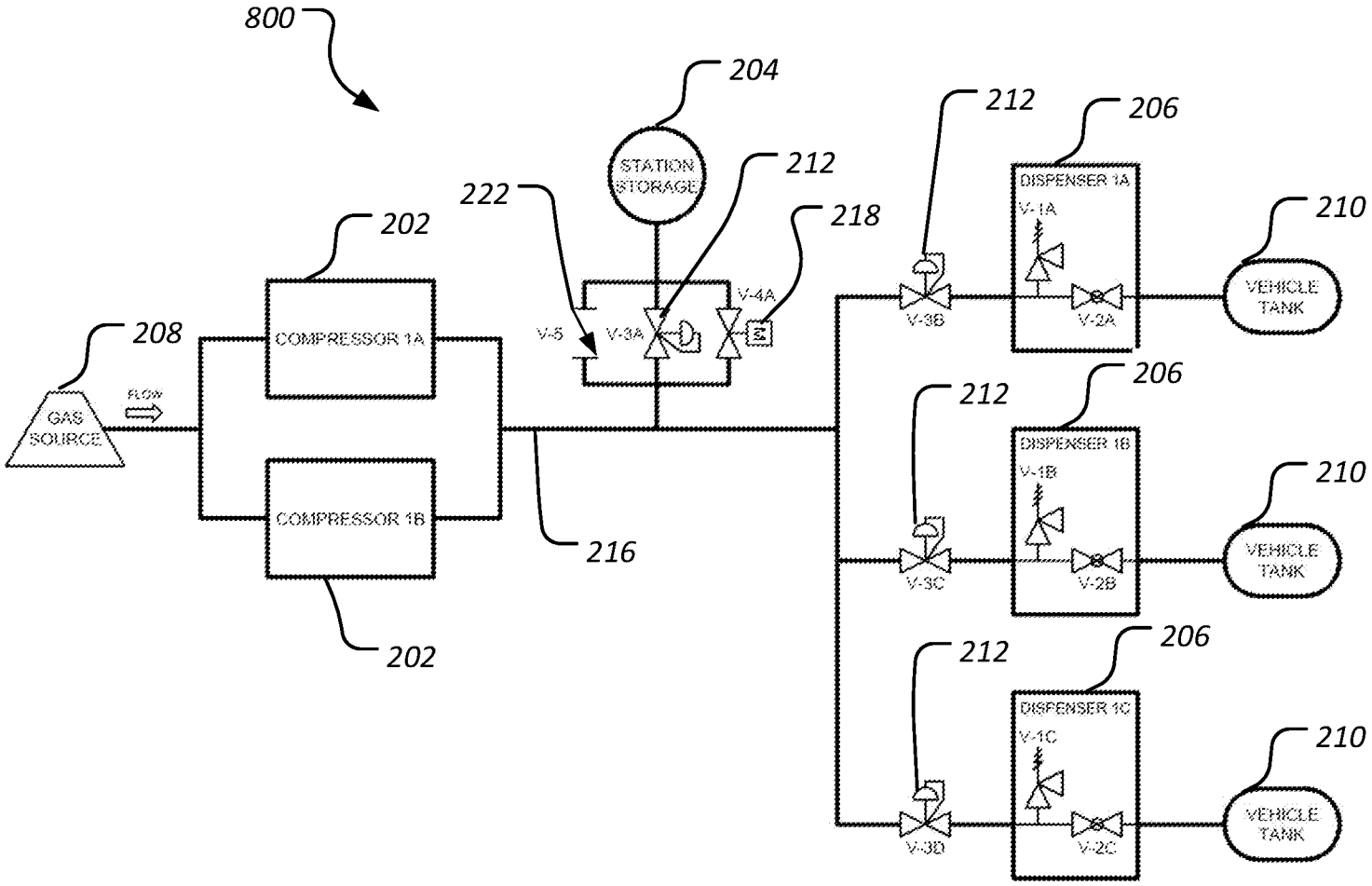
FIG. 8 is a schematic diagram of a compressed natural gas (CNG) compressed natural gas (CNG) refueling station system according to another embodiment.

Referring now to FIG. 8, a CNG refueling station system 800 is shown. System 800 comprises multiple compressors 202 feeding into a common header 216. The header 216 is connected via a control valve 212, a bypass valve 218, and check valve 222 to a bank of one or more station storage tanks 204. The common header 216 is connected to individual valves 212 (such as V-3B-V-3D) feeding three dispensers 206.

Figure 9:
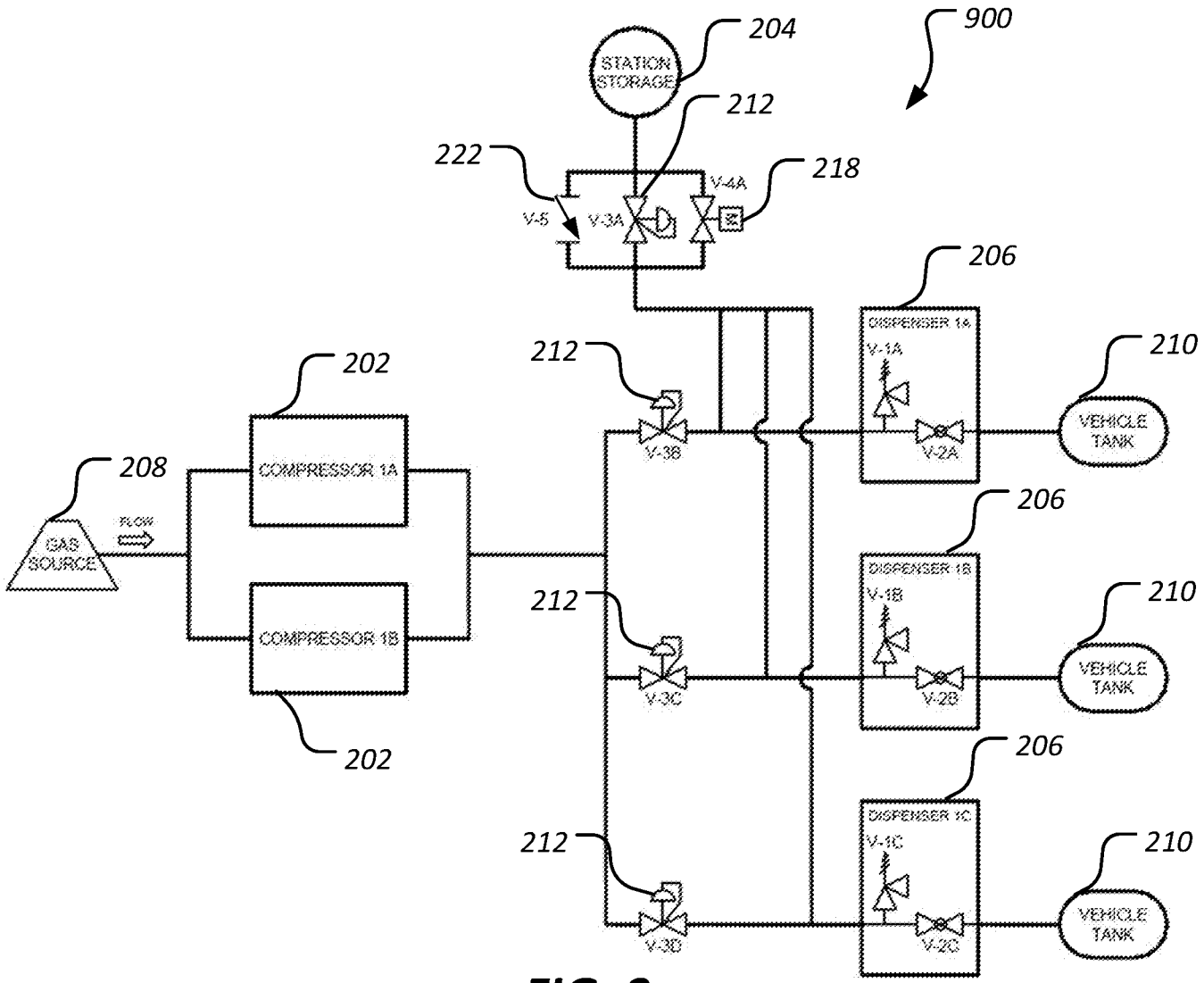
FIG. 9 is a schematic diagram of a compressed natural gas (CNG) compressed natural gas (CNG) refueling station system according to another embodiment.

Referring now to FIG. 9, a CNG refueling station system 900 is shown. The system 900 is substantially similar to the system 800. However, the station storage 204 is connected between the valves 212 (such as valves V-3B-V-3D) and the dispensers 206 rather than upstream of the valves 212 (such as valves V-3B-V-3D).

Figure 10:
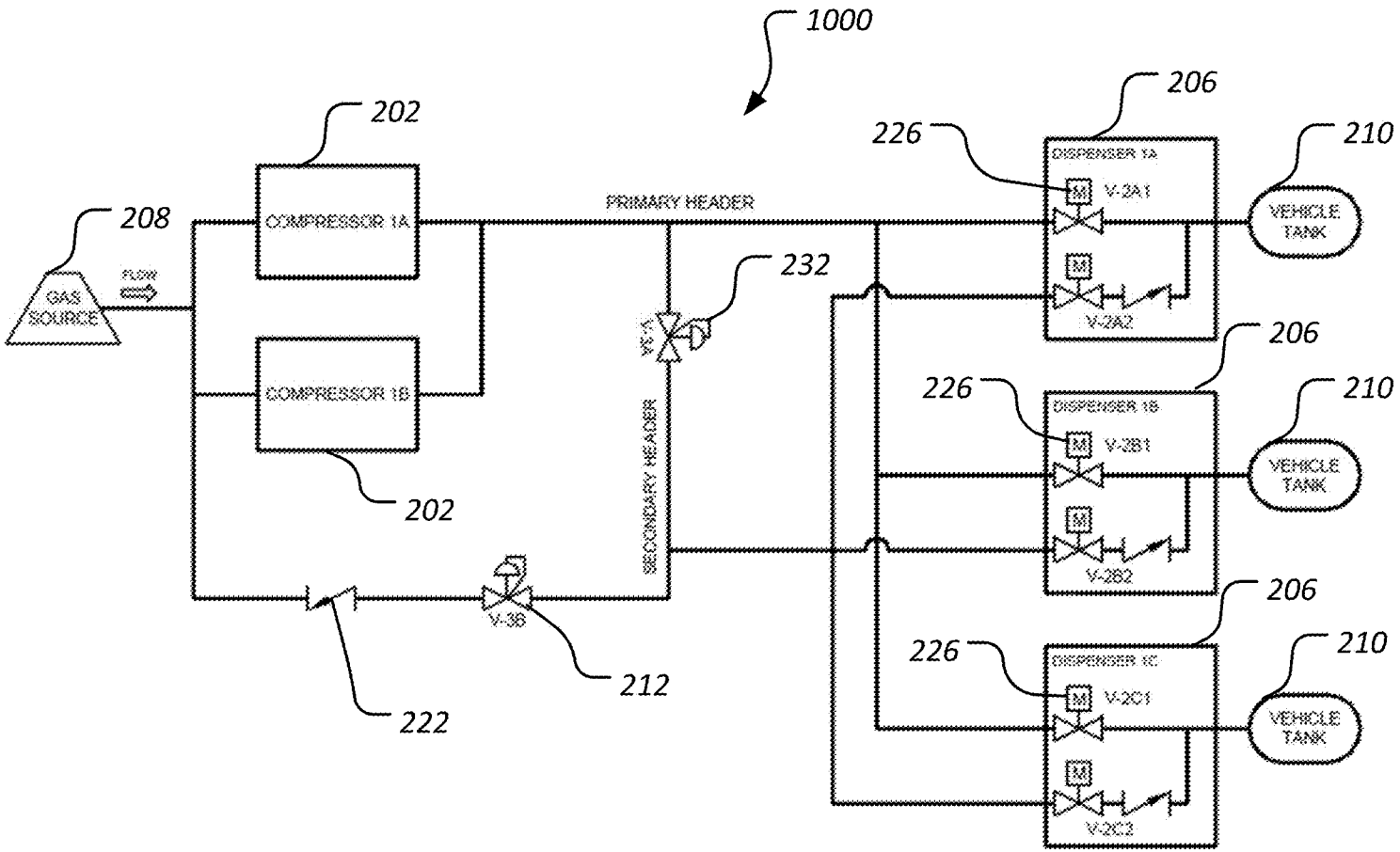
FIG. 10 is a schematic diagram of a compressed natural gas (CNG) compressed natural gas (CNG) refueling station system according to another embodiment.

Referring now to FIG. 10, a CNG refueling station system 1000 is shown. The system 1000 comprises multiple headers with a primary header configured to feed the first priority vehicle, such as a vehicle A associated with dispenser 206 (such as dispenser 1A), directly from the compressors 202 to a maximum fill pressure via dispenser actuated valves 226 (V-2A1, V-2B1 and V-2C1). Maximum fill pressure on the primary header can be maintained via control valve(s) 212 (such as valves V-3A and V-3B). Excess gas that could increase the primary header pressure above the maximum fill pressure can flow through valves 212 (such as valve V-3A) to the lower priority vehicles, such as vehicles associated with other dispensers 206 (such as dispensers 1B and 1C through valves 212 (V-2B2 and V-2C2)) on the other headers. Pressurization above the maximum fill pressure of a vehicle tank 210 is selectively prevented by a control valve 212 (such as valve V-3B) which can recycle excess gas back to the compressor 202 suction header.

Figure 11:
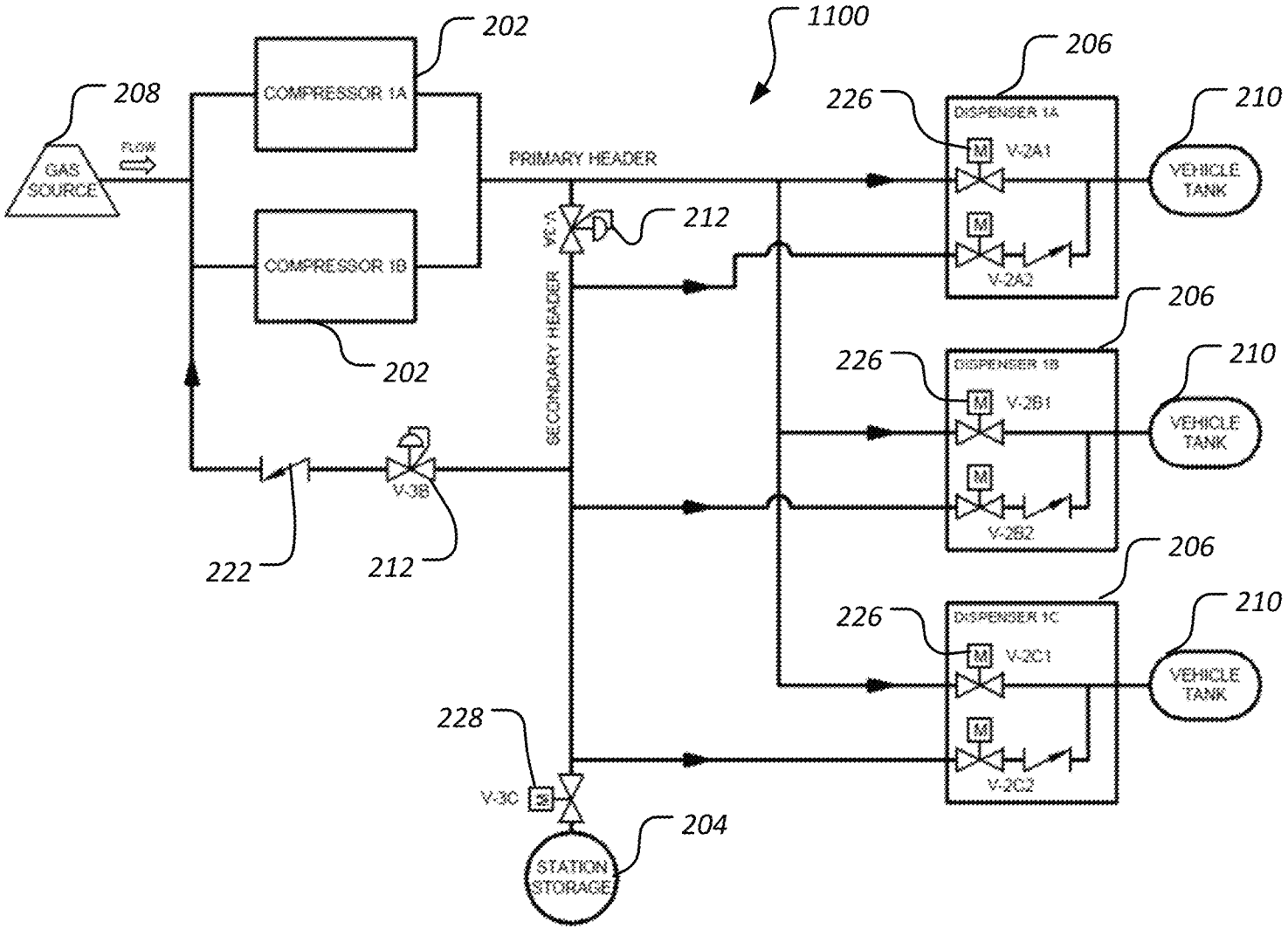
FIG. 11 is a schematic diagram of a compressed natural gas (CNG) compressed natural gas (CNG) refueling station system according to another embodiment.

Referring now to FIG. 11 a CNG refueling station system 1100 is shown. The system 1100 comprises a station storage 204 connected to lower priority headers by actuated ball valve(s) 228 (such as ball valve V-3C). Gas can free flow from station storage 204 to vehicle tanks 210 of vehicles on the lower priority header(s) until pressure is equalized between station storage 204 and the lower priority header(s). Next, the station storage 204 can be isolated by selectively actuating ball valve(s) V-3C until all vehicle tanks 210 have been filled. After all vehicle tanks 210 have been filled, station storage 204 can be refilled.

Figure 12:
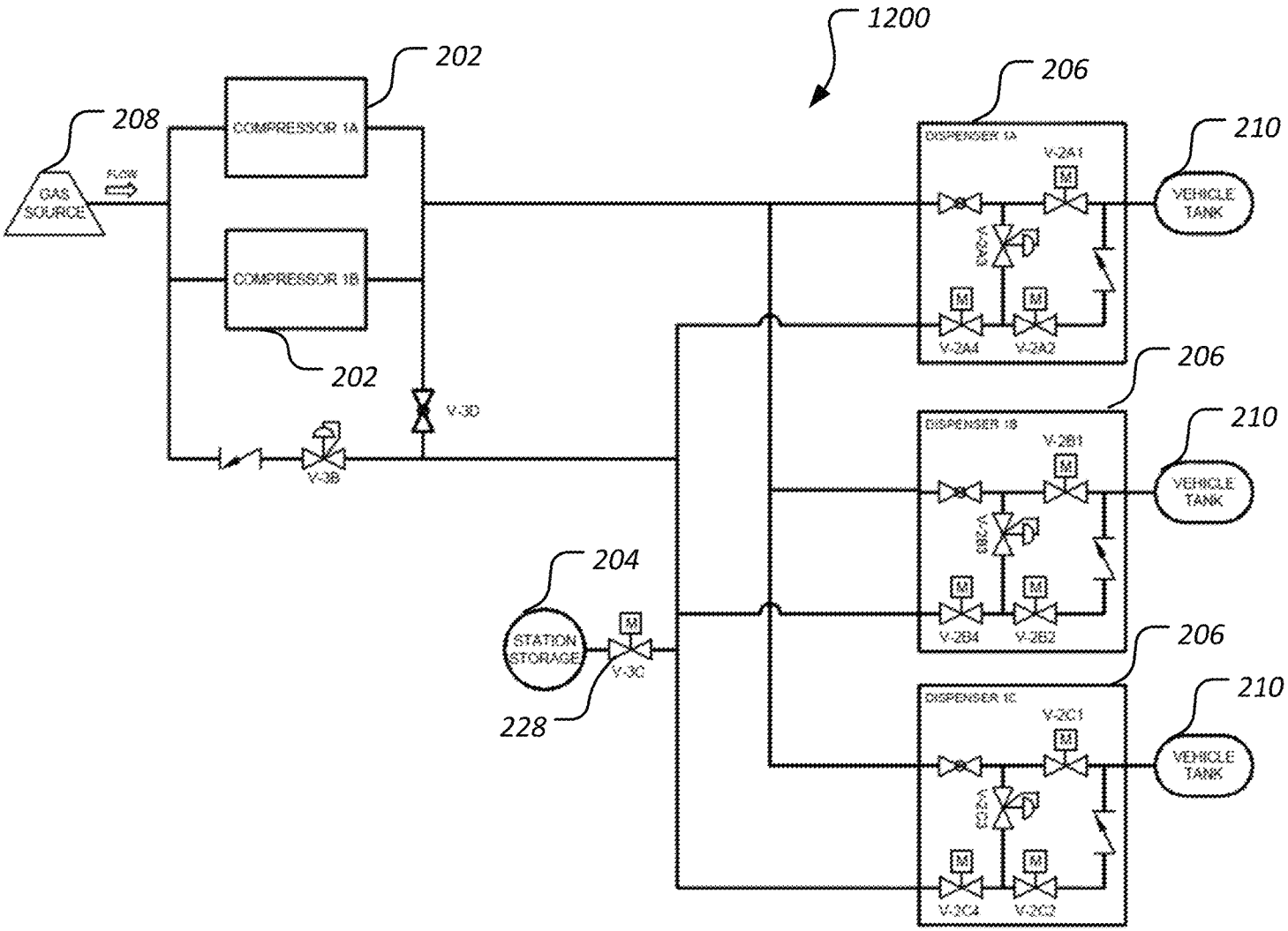
FIG. 12 is a schematic diagram of a compressed natural gas (CNG) compressed natural gas (CNG) refueling station system according to another embodiment.

Referring now to FIG. 12, a CNG refueling station system 1200 is shown. System 1200 comprises control valves disposed in the dispensers 206. Selectively controlling the control valves in the dispensers can allow for coordination between dispenser 206 controls, more precise control of the primary header pressure and redundancy in control valves. Further, the provision and/or selective control of the control valves in the dispensers 206 can allow for the dispensers 206 to be configured to function as a multiple header system filling vehicle tanks 210 at multiple pressures from the primary header and/or to be configured to function in a manner substantially similar to the functionality of other systems disclosed above by selectively changing the order of operation of valves of the dispensers 206.

Figure 13:
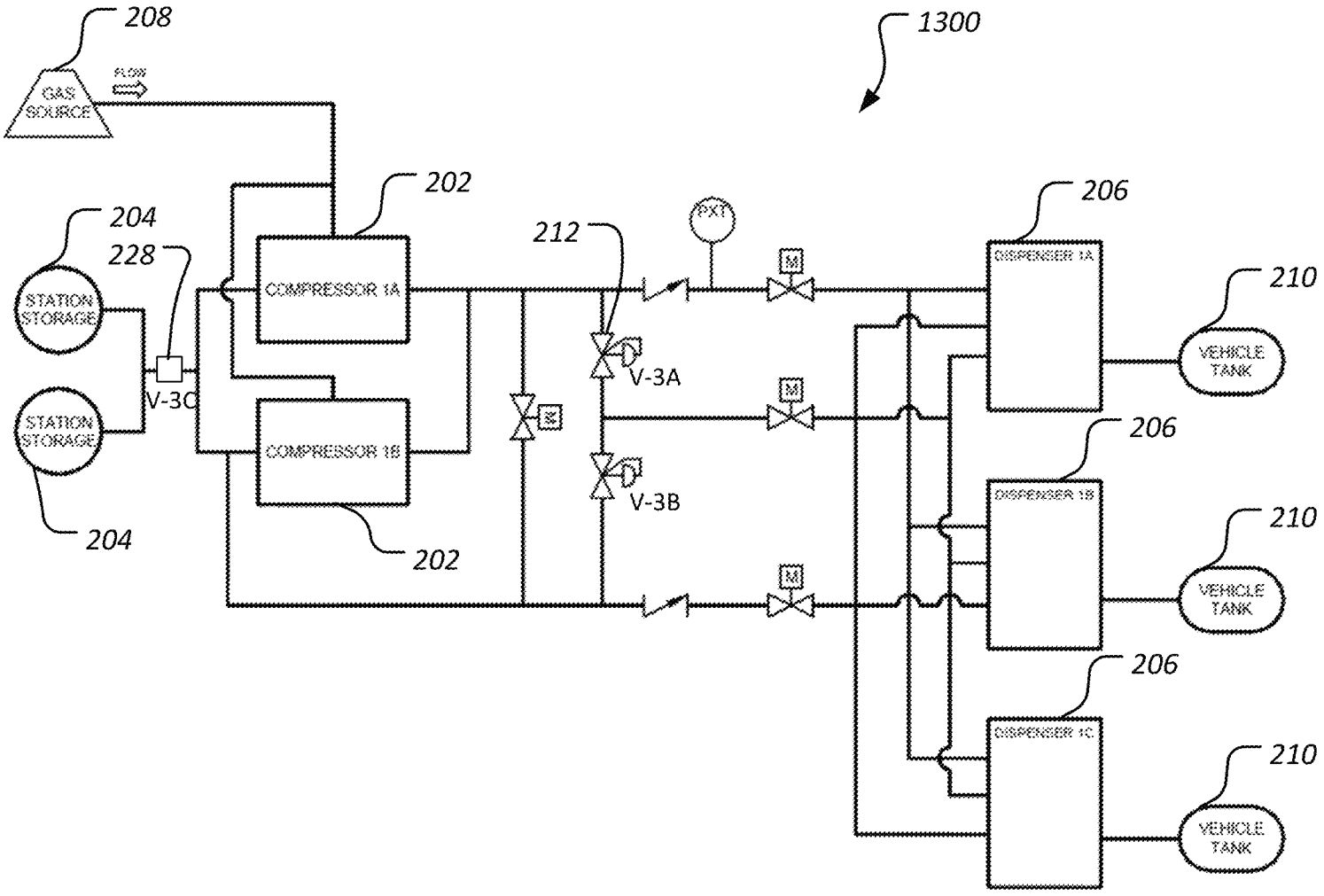
FIG. 13 is a schematic diagram of a compressed natural gas (CNG) compressed natural gas (CNG) refueling station system according to another embodiment.

Referring now to FIG. 13, a CNG refueling station system 1300 is shown. The system 1300 comprises a station storage 204 connected to each of the dispenser headers by actuated ball valve(s) 228 (such as V-3C). Gas can free flow from station storage 204 to vehicle tanks 210 via each of the header(s) until pressure is equalized between station storage 204 and the header(s) of the vehicle tanks 210 connected to the header(s). When station storage 204 pressure reaches a pressure below a full pressure, the compressor(s) 202 can start and feed gas into a high priority header. Gas can flow from the high priority header into the dispenser 206 until the vehicle tank(s) 210 connected to the high priority header cannot take as much flow and/or pressure as the compressor(s) 202 supply. The excess gas will then go through valve 212 (such as valve V-3A) to the second priority header. As with the high priority header, the gas will fill the vehicle tank(s) 210 connected to the second priority header until the vehicle tanks 210 cannot take as much flow and/or pressure as can go into the high priority header and second priority header. Next, gas can flow through valve 212 (such as valve V-3B) into the low header and/or station storage 204, thereby filling both station storages 204 and any vehicles tank(s) 210 connected to the low priority header. After all vehicle tanks 210 have been filled, station storage 204 can be refilled. In this embodiment gas can be fed to the compressors 202 either from the gas source 208 or from the station storage 204. When the gas is being feed from station storage 204, gas can be recirculated from the low priority header back to the suction of the compressor(s) 202, thereby allowing the dispenser 206 to fill vehicle tanks 210 at a rate slower than the output of the compressor(s) 202.

During filling of the vehicle tanks 210, the temperature in the vehicle tanks 210 will initially drop due to the gas expanding into the vehicle tank 210 (due to the Joule-Thomson effect). After the initial temperature drop, as filling continues, the temperature in the vehicle tank 210 will continue to rise as the pressure differential decrease (due to less Joule-Thomson effect) and increased heat caused by the heat of compression in the vehicle tank 210 being filled. The net result is an elevated temperature (above ambient temperature) within the vehicle tank 210 once the vehicle tank 210 is full. After the filling stops, the vehicle tank 210 will radiate the heat to atmosphere and the temperature will return to atmospheric temperature. As a result, the pressure in the vehicle tank 210 will fall. Accordingly, vehicle tanks 210 must be "over-filled" during the filling process to ultimately result in a "full" pressure within the vehicle tanks 210 after they cool down to atmospheric temperature. In some cases, gas can be cooled gas prior to entering the vehicle tanks 210 by using external coolers and tank baths.

Figure 14:
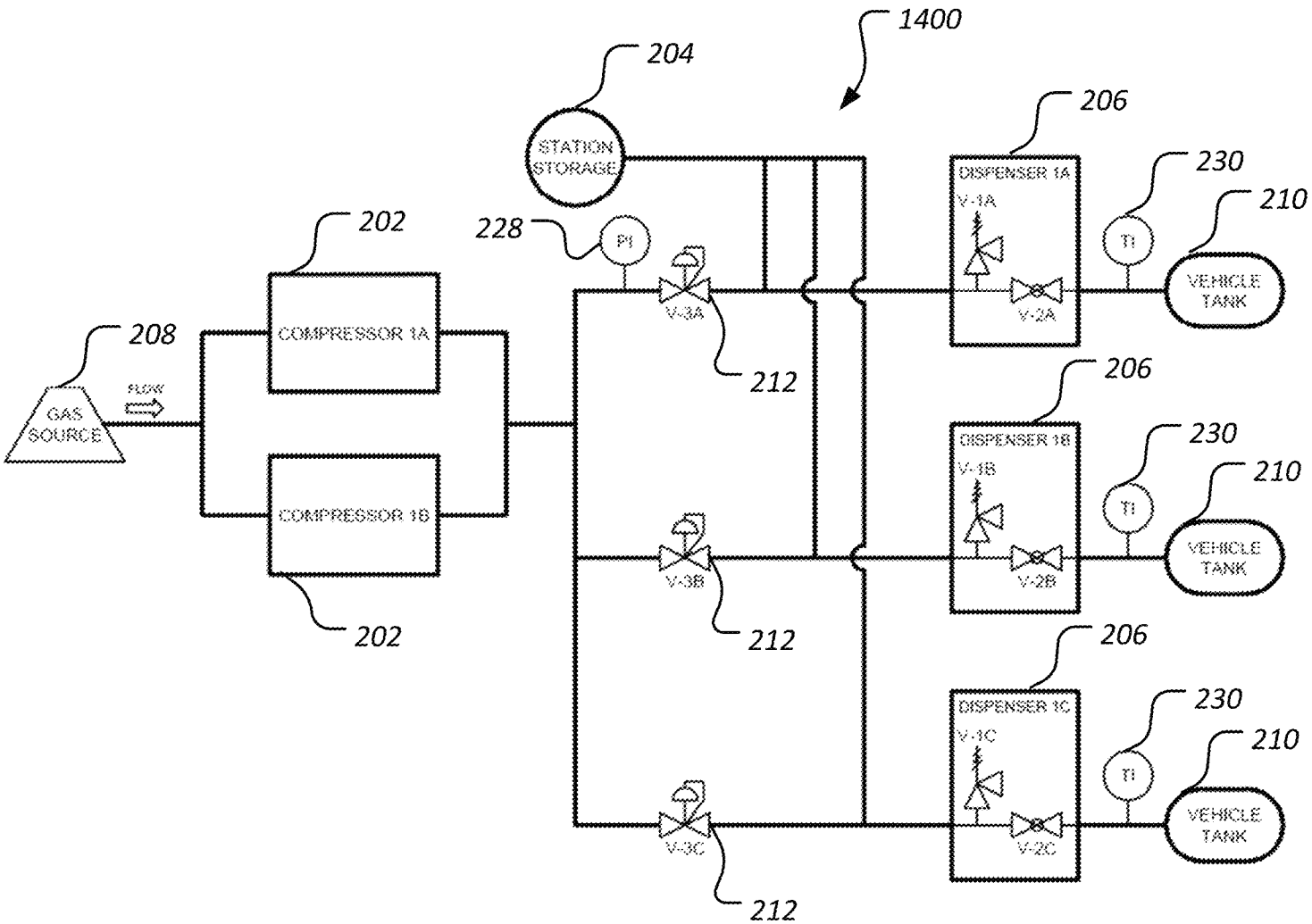
FIG. 14 is a schematic diagram of a compressed natural gas (CNG) compressed natural gas (CNG) refueling station system according to another embodiment.

Referring now to FIG. 14, a CNG refueling station system 1400 is shown. System 1400 is substantially similar to system 300 and can not only provide for first-in first-out control to provide priority filling of a selected vehicle tank 210, it can also be used to cool the gas prior to entering the vehicle tank 210. System 1400 further comprises a pressure sensor 228 and temperature sensors 230. The valves 212 described above (such as valve V-3A-V-3C) can be controlled such that during the beginning of the fill, they can be modulated to maintain a selected downstream temperature by raising an upstream pressure. This will increase the pressure differential between the gas source 208 and the vehicle tank 210, thereby delivering the gas at a lower temperature.

Figure 15:
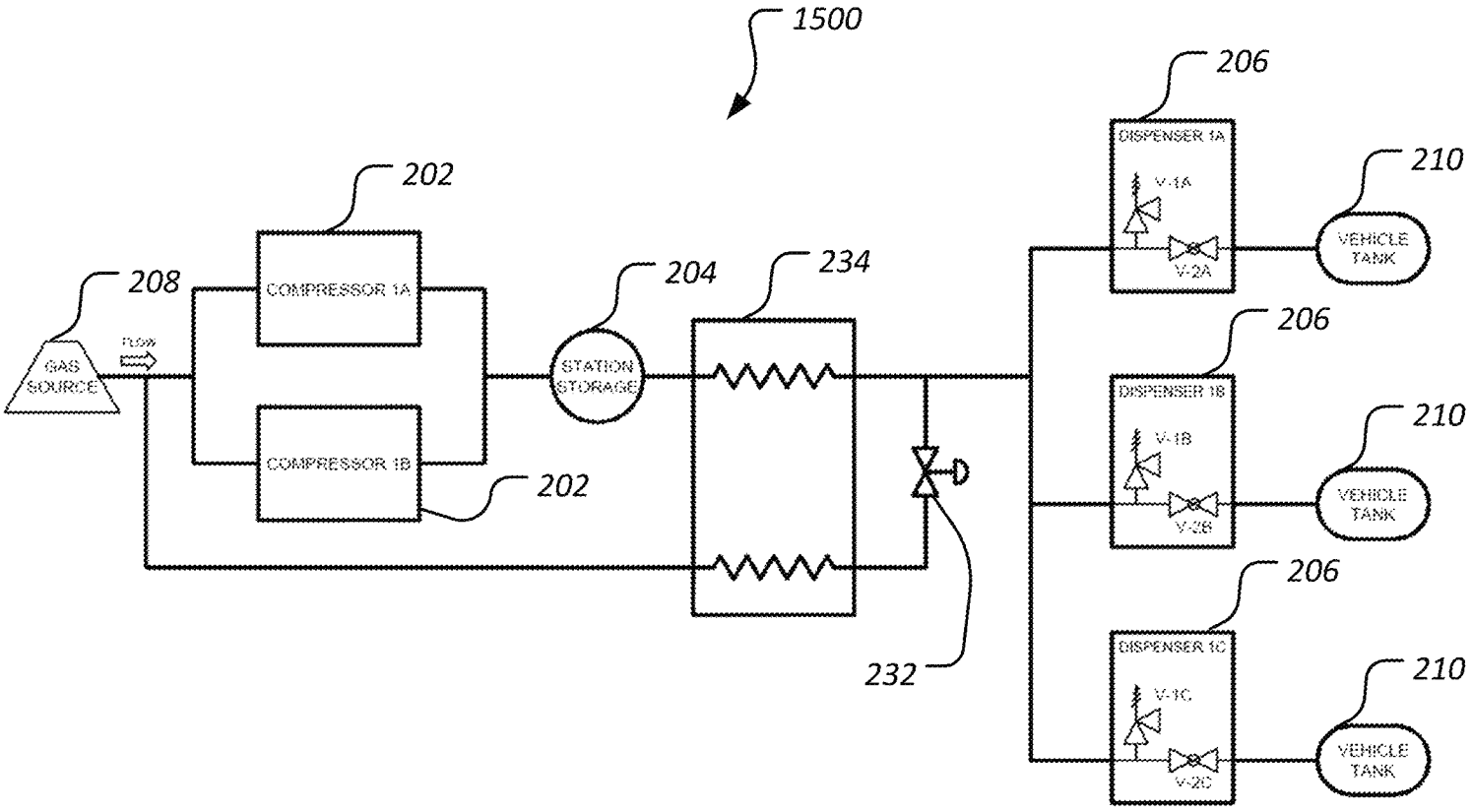
FIG. 15 is a schematic diagram of a compressed natural gas (CNG) compressed natural gas (CNG) refueling station system according to another embodiment.

Referring now to FIG. 15, a CNG refueling station system 1500 is shown. System 1500 is configured to cool gas by allowing expansion of the gas through an expansion valve 232, thereafter passing the cooled gas through the heat exchanger 234, and then feeding the gas back to the suction of compressors 202. The cooled gas exiting the expansion valve 232 cools the heat exchanger 234 which cools the gas prior to gas being provided to the dispensers 206.

Figure 16:
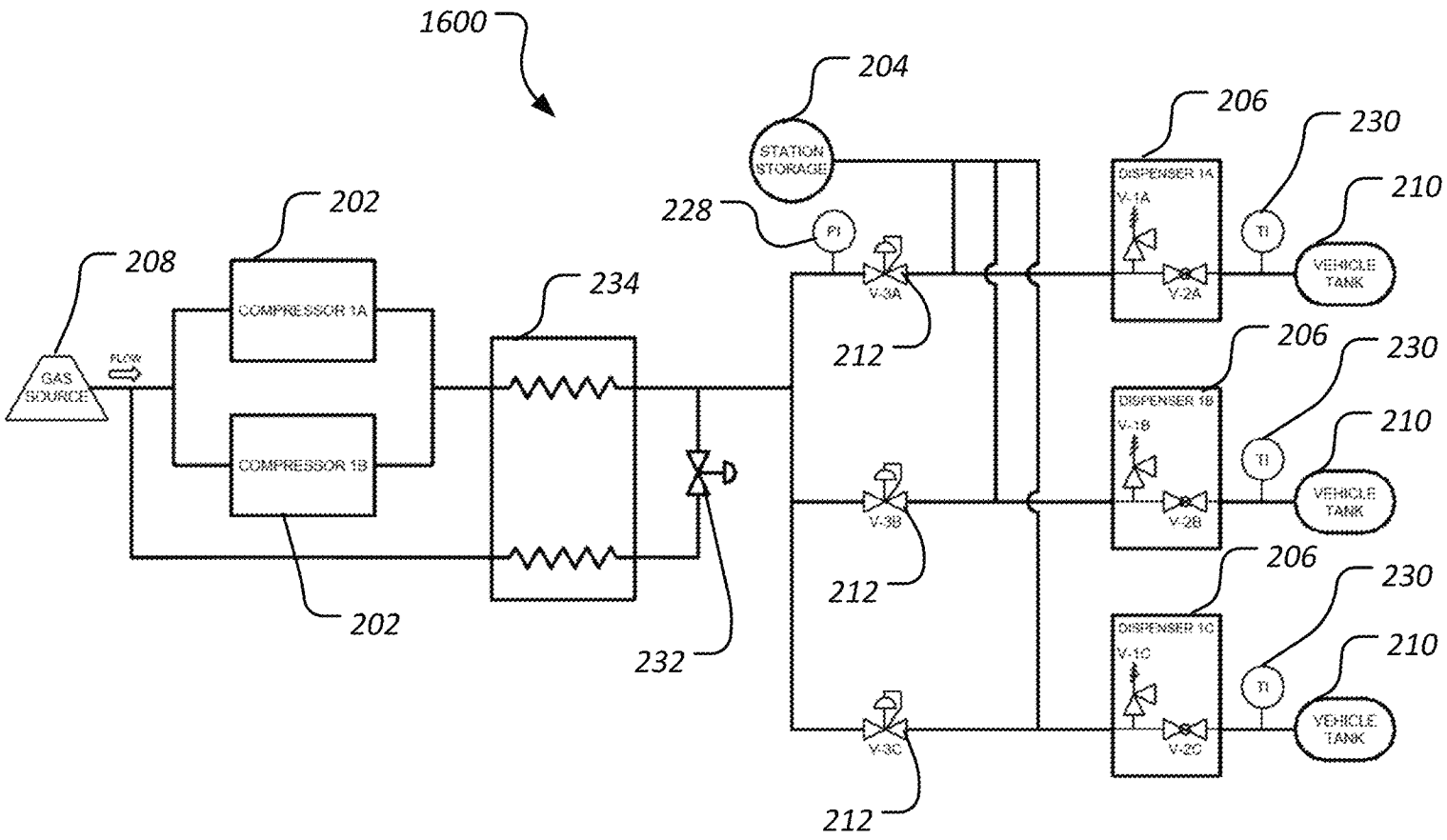
FIG. 16 is a schematic diagram of a compressed natural gas (CNG) compressed natural gas (CNG) refueling station system according to another embodiment.

Referring now to FIG. 16, a CNG refueling station system 1600 is shown. System 1600 is configured to cool gas by allowing expansion of the gas through an expansion valve 232, thereafter passing the cooled gas through the heat exchanger 234, and then feeding the gas back to the suction of compressors 202. The cooled gas exiting the expansion valve 232 cools the heat exchanger 234 which cools the gas prior to gas being provided to the dispensers 206. In this embodiment, the heat exchanger 234 is utilized in conjunction with the control valves 212 (such as valves V-3A-V-3C).

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A compressed natural gas (CNG) refueling station system, comprising:

a compressor;

a first dispenser configured to selectively receive CNG from the compressor;

a second dispenser configured to selectively receive CNG from the compressor;

a first valve disposed in fluid communication between the compressor and the second dispenser; and a heat exchanger comprising a first CNG path and a second CNG path, the first CNG path being disposed between the first valve and the compressor and the second CNG path being disposed between an output of the first CNG path and the compressor;

wherein the first valve is selectively operable to maintain at least one of a predetermined CNG flow rate and a predetermined CNG pressure supplied to the first dispenser.

2. The CNG refueling station system of claim 1, further comprising:

a second valve disposed between the first valve and the second dispenser.

3. The CNG refueling station system of claim 2, further comprising:

a first bypass valve connected upstream relative to the first valve and connected downstream relative to the first valve.

4. The CNG refueling station system of claim 3, further comprising:

a second bypass valve connected upstream relative to the second valve and connected downstream relative to the second valve.

5. The CNG refueling station system of claim 2, further comprising:

a second bypass valve connected upstream relative to the second valve and connected downstream relative to the second valve.

6. The CNG refueling station system of claim 2, further comprising:

a check valve connected upstream relative to the first valve and connected downstream relative to the first valve.

7. The CNG refueling station system of claim 1, further comprising:

an expansion valve disposed between the output of the first CNG path and an input of the second CNG path.

8. The CNG refueling station system of claim 1, further comprising:

a pressure sensor configured to measure a pressure of CNG between the first valve and an input to the compressor; and a first temperature sensor configured to measure a temperature of CNG being provided by the second dispenser.

* * * * *